United States Patent [19]

Matthies

[11] 4,345,233

[45] Aug. 17, 1982

[54] MANUAL SWITCH WITH TIMED ELECTRO-THERMAL LATCH RELEASE

[75] Inventor: Alan A. Matthies, Milwaukee, Wis.

[73] Assignee: Eaton Corporation, Cleveland, Ohio

[21] Appl. No.: 239,872

[22] Filed: Mar. 2, 1981

[51] Int. Cl.[3] ..... H01H 37/74

[52] U.S. Cl. ..... 337/75; 307/141; 337/79; 337/81

[58] Field of Search ..... 337/51, 75, 79, 77, 337/81, 88, 127, 165, 301, 341; 307/10 LS, 141; 361/211; 219/203, 511

[56] References Cited

U.S. PATENT DOCUMENTS 3,562,689 2/1971 Bar ..... 337/77

3,569,887 3/1971 Brown ..... 337/81

*Primary Examiner*—William H. Beha, Jr.

*Attorney, Agent, or Firm*—C. H. Grace; L. G. Vande Zande

[57] ABSTRACT

A momentary ON rocker button switch (2) with bimetal detent latching (36) in the ON position and releasable by a heater (42) wound on the bimetal (36), the heater (42) being controlled through the output of a solid state timing circuit (TC, R1, C1) housed in the switch which is energized upon closure of the switch contacts (14*a*, 18).

6 Claims, 6 Drawing Figures

Fig. 2
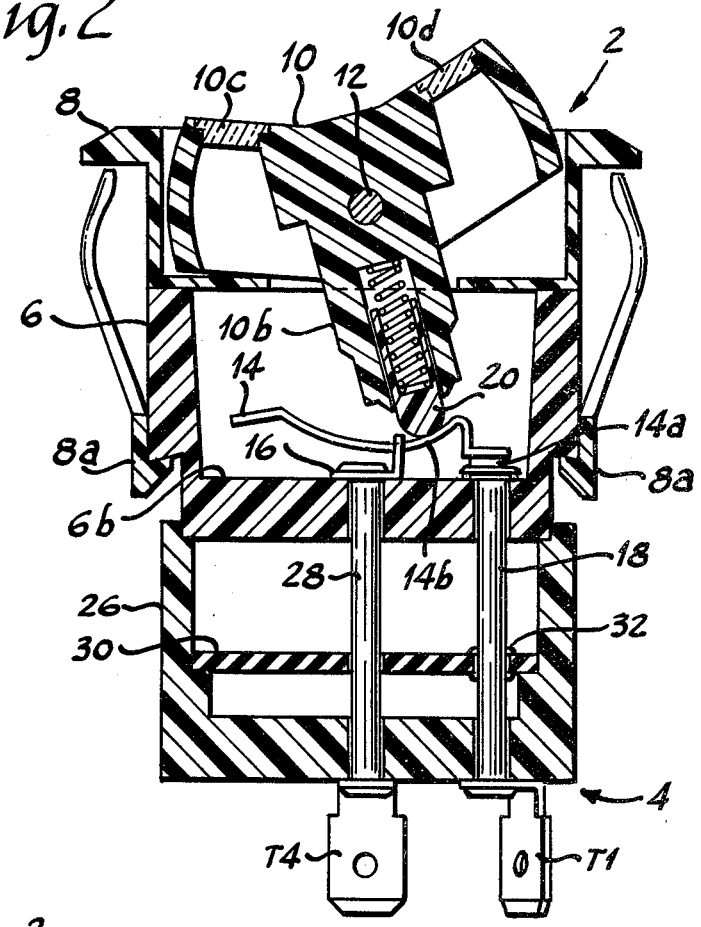
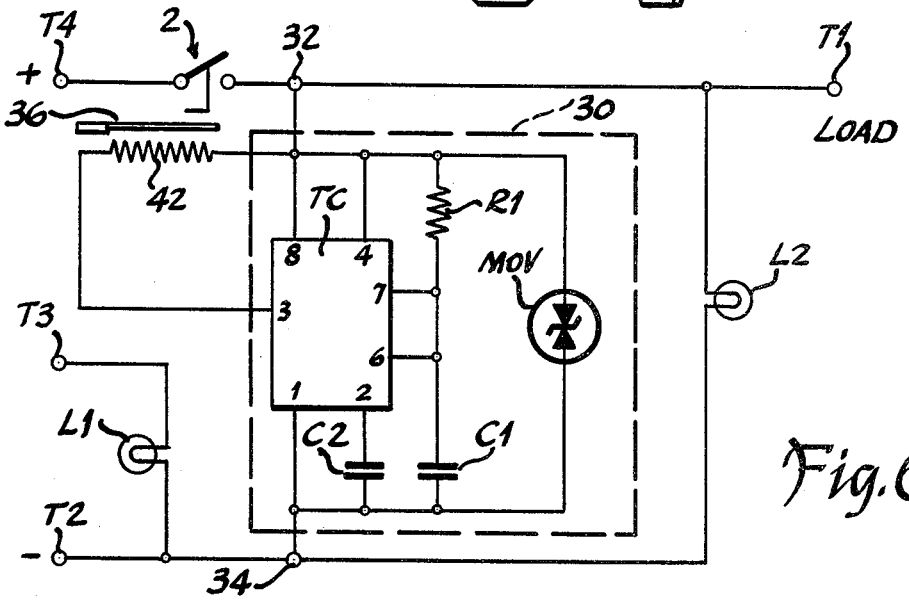
Fig. 6

MANUAL SWITCH WITH TIMED ELECTRO-THERMAL LATCH RELEASE

BACKGROUND OF THE INVENTION

Electric switches which operate from one contact condition to another in response to a thermal latch mechanism have been known heretofore. A common device of this category is a circuit breaker used to protect a device or a circuit from damage due to excessive currents. The circuit breaker contacts are manually operable to open and close the circuit, and are latched in the closed position by a thermal element. Excessive current flowing through the circuit breaker cause the thermal element to release the contacts to the open condition, disconnecting power to the protected device or circuit.

Another switch of the aforementioned type is a time delay thermal release switch wherein manual movement to close the switch contacts against a thermal release latch also energizes the thermal circuit. Automatic opening of the switch contacts is dependent upon the time required to heat the thermal latch element sufficiently to release the contacts. An example of this type of switch may be found in U.S. Pat. No. 2,507,949 issued May 16, 1950 to J. K. Asder. This switch further discloses a mechanical adjustment feature to change the time interval. The time delay interval provided by this type of switch is normally of relatively short duration.

My copending application Ser. No. 157,698 filed June 9, 1980 and assigned to the assignee of this application discloses still another type of manually operated thermal release switch. In that application, a manually operable switch includes an electro-thermal latch for holding the switch in the on position. Provisions are made to energize the thermal latch from a remote location to turn the switch off.

While the foregoing switches are all useful for their intended purposes, this invention relates to improvements thereover.

SUMMARY OF THE INVENTION

This invention provides a manually operable switch with a timed electro-thermal release latch mechanism.

It is an object of this invention to provide an improved manually operable switch having a time delayed electro-thermal latch release.

It is a further object of this invention to provide a manually operable, timed electro-thermal latch release switch having improved timing means.

It is a further object of this invention to provide a manually operable electric switch having a timed, electro-thermal latch release comprising an insulating housing, switch contacts mounted in said housing, operator means mounted in said housing and manually operable to actuate said contacts between open and closed circuit positions, means biasing said contacts to a normally open circuit position, electro-thermal latch means mounted in said housing and operable in a deenergized condition to restrain said operator means in a position effecting a closed circuit position of said contacts, and electric timing means mounted in said housing energizable upon closure of said switch contacts to initiate a timing period and operable upon completion of said timing period to energize said electro-thermal latch means to release said operator means and causing said switch contacts to be opened.

These and other objects will become apparent in the following description and claims when read in conjunction with the drawings.

BRIEF DESCRIPTION OF THE DRAWINGS

FIG. 2 is a vertical cross-sectional view similar to FIG. 1 but taken substantially along the line 2—2 indicated in FIG. 4 and showing the contact mechanism of the switch;

FIG. 6 is a diagram of the circuitry embodied in the switch of this invention.

DESCRIPTION OF THE PREFERRED EMBODIMENT

Figure 1:
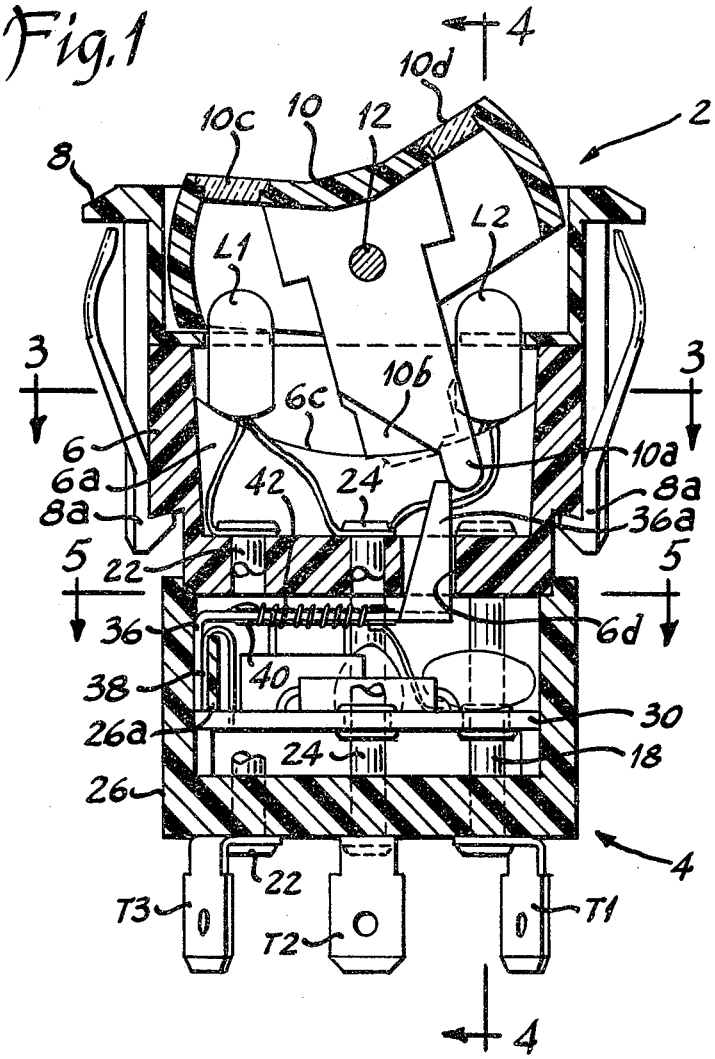
FIG. 1 is a vertical cross-sectional view of the switch of this invention taken substantially along the line 1—1 indicated in FIG. 4 showing the electro-thermal latch mechanism and a printed circuit board embodying the timing circuit.
Figure 3:
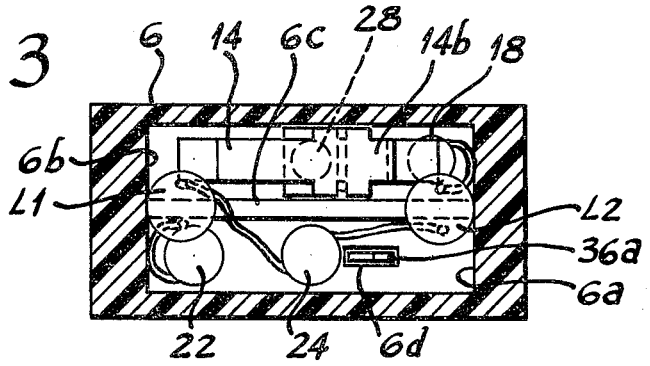
FIG. 3 is a horizontal cross-sectional view taken substantially along the line 3—3 indicated in FIG. 1 showing a lamp and contact arrangement for the switch.
Figure 4:
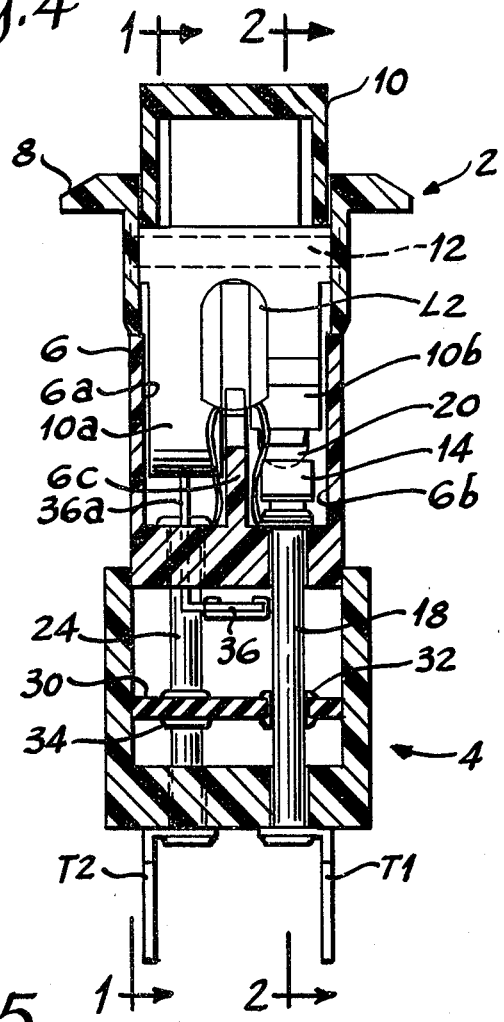
FIG. 4 is a vertical, transverse cross-sectional view taken substantially along the line 4—4 indicated in FIG. 1.

The switch of this invention comprises a single pole momentary ON rocker button switch 2 to which a time delay, electro-thermal latch mechanism 4 is attached. Referring to FIGS. 1 and 2, the switch unit 2 comprises an insulating base 6 and an insulating frame 8 snap-fit secured together by resilient hook members **8*a* integral with and depending from frame 8 which engage notches formed on the base 6. A rocker type operator button 10 is pivotally mounted in an open top portion of frame 8 by a rivet 12. Button 10 has a pair of depending actuator portions 10*a* and 10*b* which extend respectively into cavities 6*a* and 6*b* of base 6, the cavities being separated by an upstanding rib 6*c***.

The single-pole contact mechanism of switch 2 is shown in FIG. 2 and is situated in cavity **6*b*. The contact mechanism comprises a movable contactor 14 pivotally positioned upon the upstanding leg of a central contact 16. A contact element 14*a* is secured to the underside of the right hand end of contactor 14 for engagement with the head of a rivet 18, the latter serving as a stationary contact. Intermediate its right hand end and the pivotal support point, contactor 14 has a relatively steep arcuately sloped portion 14*b***.

Actuator portion **10*b* of button 10 has a central bore opening to its lower end which receives a plunger 20. A helical compression spring is also positioned within the bore to bias plunger 20 outwardly of actuator 10*b* and into engagement with the upper surface of the contactor 14. Movement of rocker button 10 about the pivot 12 causes plunger 20 to traverse contactor 14 from one side of the pivot of contact 16 to the other, respectively moving the contact 14*a* into engagement with rivet 18 to bridge the circuit between contact 16 and rivet 18, and out of engagement with rivet 18 to open that circuit. In the absence of any restraining force such as operator finger pressure upon button 10 or a latching mechanism to be described later, the interaction of spring biased plunger 20 and the arcuately sloped portion 14*b* of contactor 14 causes the actuator portion 10*b*** of button 10 to pivot clockwise as viewed in FIG. 2 to the left side of contact 16, thereby opening the contacts 14*a* and 8. Accordingly, switch 2 is normally in the open circuit or OFF position and is in the closed circuit or ON position momentarily, only as long as an operating or restraining force is present.

Switch 2 is also provided with a pair of indicating lamps L1 and L2 for reasons to be described later. The leads of lamp L1 are connected to rivets 22 and 24 by entrapping the lead wire around the respective rivet between the head of the rivet and the bottom wall of the base 6. The leads of lamp L2 are similarly connected to rivets 18 and 24. Operator button 10 is provided with inset lense members 10*c* and 10*d* in the operating face thereof to permit light transmission from the respective lamp to the front of the switch.

The time delay electro-thermal latch mechanism 4 is contained in a separate sub-housing 26 and is attached as a unit to the rear of switch 2. Attachment is accomplished by the aforementioned rivets 18, 22 and 24 and a fourth rivet 28 which secures central contact 16 in cavity 6*b*. As seen in the drawings, these rivets extend from the interior of switch unit 2, through base 6 and sub-housing 26 to the exterior rear surface of the latter where they secure terminals T1, T3, T2 and T4, respectively. A printed circuit board 30 is positioned in sub-housing 26 to rest upon ledges formed in the four corners of the housing cavity. Electrical connection for the circuitry contained on board 30 is made by conductive grommets 32 and 34 which respectively receive rivets 18 and 24.

Figure 5:
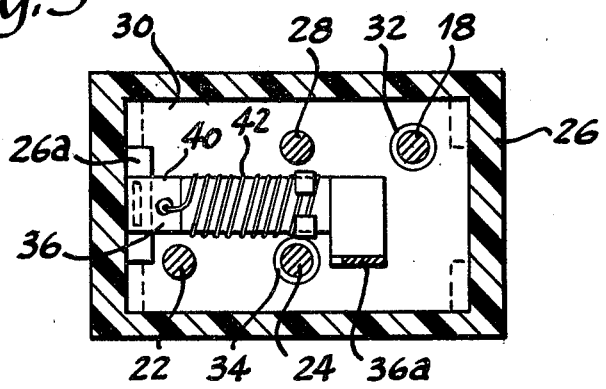
FIG. 5 is a horizontal cross-section view taken substantially along the line 5—5 indicated in FIG. 1 showing the electro-thermal latch release element.

As best seen in FIGS. 1 and 5, a thermal latch member comprises an L-shaped bimetal element 36, the vertically extending short leg of which is received in a slot formed in a rectangular boss 26*a* of sub-housing 26. An inverted U-shaped connector 38 (FIG. 1) serves to wedge the bimetal element 36 securely in position in the sub-housing 26 and to electrically connect the bimetal element to the printed circuit board 30. The horizontally extending longer leg of element 36 extends along the underside of switch base 6 between the rivets 24 and 28. This leg of bimetal element 36 is provided with an insulating sleeve 40 around which is wrapped several turns of a heater wire 42, electrically isolated from the bimetal by the sleeve 40. The left-hand end of wire 42 is brought out beyond insulating sleeve 40 and is soldered to the bimetal element to be electrically connected thereto. The opposite end of wire 42 is clamped in position over the insulator sleeve and a projecting end of the wire is soldered to a connection point on the circuit board 30. The free end of bimetal element 36 is provided with and upstanding latch member 36*a* which may be a separate member attached to the bimetal or may be an integral portion thereof formed upwardly. Latch member 36*a* extends through a passageway 6*d* formed in the rear wall of base 6 to project into cavity 6*a*. With particular reference to FIG. 1, it is to be noted that in its normal condition, bimetal element 36 causes latch member 36*a* to interfere with the lower end of actuator portion 10*a* of button 10, thereby restraining the button 10 against return movement to the OFF position under the influence of spring biased plunger 20 acting upon surface 14*b* of contactor 14. However, bimetal element 36 does have sufficient flexibility to permit the latch member 36*a* to be cammed downward by actuator portion 10*a* when operator pressure is exerted on the button to manually move it to the OFF position. Alternatively, if current is caused to flow in heater wire 42, the bimetal element 36 will become heated and the free end thereof will deflect downwardly to withdraw latch member 36*a* from engagement with actuator portion 10*a*. Button 10 will then be free to return to the OFF position under the influence of plunger 20 interacting with portion 14*b* as aforedescribed.

The elements providing the timing function for the switch of this invention are mounted on printed circuit board 30. With specific reference to FIG. 6 wherein the circuit diagram for the complete switch is shown, an integrated timing circuit TC is connected across the supply terminals T4 and T2 in series with the contacts of switch 2. While there are several integrated timing circuits available for use in this device, the particular circuit used in this invention is a 555 timer. A resistor R1 and capacitor C1 are connected across the timing circuit TC, the junction of these elements being connected to the threshold terminal of that circuit to establish a timing constant for the circuit. A small capacitor C2 connects the trigger terminal of timer TC to the negative supply terminal T2 to hold that terminal low and render the circuit under the control of switch 2. The output terminal of timer TC is connected to one side of the bimetal heater wire 42 while the other end thereof is connected to the positive side of the supply voltage at the output contact of switch 2. A metal oxide varistor MOV is connected across the timer TC to provide protection against transient voltage surges.

The indicator lamps L1 and L2 are also shown in FIG. 6. Lamp L2 is connected across terminals T1 and T2 in series with the contacts of switch 2 and is illuminated when the contacts are closed. Lamp L1 is connected between terminal T3 and negative supply terminal T2 and is illuminated under the control of an external signal.

A principal application of the manually operable, timed electro-thermal release switch described above is to control an automobile rear window defogger. In such application the terminals T4 and T2 are connected across the 12 volt DC supply of the vehicle electrical system, and terminal T1 is connected to the defogger heater element. Terminal T3 may be connected to the switch controlling the dashboard lights to illuminate lamp L1 whenever the vehicle dashboard lights are on.

The operation of the device will now be described. Movement of rocker button 10 to the position shown in FIGS. 1 and 2 will close contact 14*a* upon the head of rivet 18, completing the circuit from terminal T4 to terminals T1 and T2. The contacts are retained in the closed position by latch member 36*a* as aforedescribed. The completed circuit sets the timer circuit TC through capacitor C2 to the negative side of the supply and current flowing through resistor R1 and capacitor C1 begins to charge capacitor C1. Current flowing from terminal T1 energizes the load device which, in this case, is the defogger heater element. Lamp L2 is illuminated to indicate that the defogger heater element is energized. The setting of timing circuit TC causes its output terminal to immediately go high, that is, to be at the positive supply voltage to prevent current flow through bimetal heater wire 42.

The threshold level of the 555 timing circuit TC is characteristically $\frac{2}{3}$ of the supply voltage. When capacitor C1 has charged to this threshold voltage the timing circuit operates to drive the output voltage low and to discharge capacitor C1. A low signal on the output terminal causes current flow in bimetal heater wire 42 which in turn heats the bimetal element 36, causing it to deflect downwardly. This movement of bimetal 36 withdraws latch member 36*a* from engagement with actuator portion 10*a*, permitting rocker button 10 to move to the opposite position under the interaction of spring biased plunger 20 and sloped portion 14*b* of contactor 14, thereby opening the contacts 14*a* and 18. The opened contacts of switch 2 interrupt the flow of current to the defogger heater element, lamp L2 and the timing circuit.

Another characteristic of the 555 timing circuit used in this device is that the trigger level thereof is at $\frac{1}{3}$ the supply voltage. Thus at the end of a timing period the timing circuit abruptly discharges capacitor C1 to $\frac{1}{3}$ the supply voltage. Further discharge of capacitor C1 occurs at a much slower rate, leaking off over a period of two or three minutes. If the initial period of energization of the defogger heater element was not of sufficient duration to clear the window, the switch 2 may again be operated to repeat the procedure aforedescribed. When successively reset, timing circuit capacitor C1 begins charging from the level to which it has discharged, which is at or near $\frac{1}{3}$ the supply voltage dependent upon the time which has elapsed between completion of the timed period and resetting of the circuit. Accordingly, the time required for that capacitor to charge to the threshold level is approximately $\frac{1}{2}$ the time required for the initial operation. Subsequent operations of the switch will also be for approximately $\frac{1}{2}$ of the initial time interval.

It will be appreciated that manual operation of switch 2 to the OFF position, overriding the detent function of latch 36*a*, will interrupt power to the defogger heater and the timing circuit at any point in the timing cycle. Specific time periods such as 10 minutes, 5 minutes may be achieved by appropriate selection of values for resistor R1 and capacitor C1.

While the apparatus hereinbefore described is effectively adapted to fulfill the objects stated, it is to be understood that the invention is not intended to be confined to the particular preferred embodiment of manually operable switch with timed, thermal release disclosed, inasmuch as it is susceptible of various modifications without departing from the scope of the appended claims.

We claim:

1. A manually operable electric switch having a timed, electro-thermal latch release comprising, in combination:

an insulating housing;

switch contacts mounted in said housing;

operator means mounted in said housing and manually operable to actuate said contacts between open and closed circuit positions;

means biasing said contacts to a normally open circuit position;

electro-thermal latch means mounted in said housing and operable in a de-energized condition to restrain said operator means in a position effecting a closed circuit position of said contacts; and electric timing means mounted in said housing energizable upon closure of said switch contacts to initiate a timing period and operable upon completion of said timing period to energize said electro-thermal latch means to release said operator means and causing said switch contacts to be opened.

2. The switch as claimed in claim 1 wherein:

said timing means is a solid state timing circuit.

3. The switch as claimed in claim 2 wherein:

said solid state timing circuit is of a type providing a shortened timing period upon an immediately successive energization thereof.

4. The switch as claimed in claim 2 wherein:

said electro-thermal latch means comprises:

an elongated bimetal element mounted at one end in said housing and having the free end thereof engaging said operator means when the latter is in said position effecting a closed circuit position of said contacts;

a heater wire in heat conducting relation to said bimetal element; and means connecting said heater wire to the output of said timing circuit to enable current to flow through said heater wire upon completion of said timing period.

5. The switch as claimed in claim 4 wherein:

said housing comprises first and second housing parts, said switch contacts, operating means and biasing means being mounted in said first housing part and said timing circuit, bimetal element and heater wire being mounted in said second housing part;

a passageway communicating between said first and second housing parts through which the free end of said bimetal element extends;

said housing parts being secured together by conductive rivets extending from said first housing part through said second housing part to an exterior surface of said second housing part, at least two of said rivets having connection with respective ones of said switch contacts to provide external terminations therefor.

6. The switch claimed in claim 5 wherein:

said timing circuit includes a printed circuit board; and a pair of electrical connectors for said timing circuit on said printed circuit board respectively engaging one of said rivets connected to a load side one of said switch contacts and to a third one of said conductive rivets providing external termination for connection to a return side of an electrical supply source.

* * * * *